United States Patent [19]

Sullivan

[11] Patent Number: 4,644,866

[45] Date of Patent: Feb. 24, 1987

[54] AMMUNITION ROUND

[75] Inventor: Leroy J. Sullivan, Huntington Beach, Calif.

[73] Assignee: Branscomb Corporation N.V. of Curacao, Netherlands, Curacao, Netherlands Antilles

[21] Appl. No.: 621,735

[22] Filed: Jun. 18, 1984

[30] Foreign Application Priority Data

| | | | |
|---|---|---|---|
| Jun. 22, 1983 | [EP] | European Pat. Off. | 83106054.6 |
| Jan. 13, 1984 | [EP] | European Pat. Off. | 84100331.2 |
| Jan. 13, 1984 | [EP] | European Pat. Off. | 84106760.6 |

[51] Int. Cl.[4] ..... F42B 11/00

[52] U.S. Cl. ..... 102/439; 102/501; 102/520

[58] Field of Search ..... 102/430, 433, 434, 436, 102/439, 501, 517–523

[56] References Cited

U.S. PATENT DOCUMENTS

| | | | |
|---|---|---|---|
| 1,218,546 | 3/1917 | Gillis | 102/436 |
| 3,164,092 | 1/1965 | Reed et al. | 102/522 |
| 3,916,792 | 11/1975 | Elmore et al. | 102/436 |
| 4,056,060 | 11/1977 | Devine | 102/52 |
| 4,063,511 | 12/1977 | Bullard | 102/38 |
| 4,083,306 | 4/1978 | Woodring | 102/520 |
| 4,353,302 | 10/1982 | Strandli et al. | 102/518 |
| 4,444,114 | 4/1984 | Bisping et al. | 102/523 X |

FOREIGN PATENT DOCUMENTS

| | | | |
|---|---|---|---|
| 583098 | 8/1933 | Fed. Rep. of Germany . | |
| 2831574 | 2/1979 | Fed. Rep. of Germany . | |
| 736690 | 11/1932 | France . | |
| 799933 | 6/1936 | France . | |
| 861167 | 2/1941 | France . | |
| 1124740 | 4/1955 | France . | |
| 2420116 | 3/1978 | France | 102/520 |
| 2365098 | 4/1978 | France . | |
| 107088 | 6/1917 | United Kingdom . | |

*Primary Examiner*—Harold J. Tudor
*Attorney, Agent, or Firm*—Needle & Rosenberg

[57] ABSTRACT

In an ammunition round a substantially full bore diameter bullet has a plurality of elongate grooves either helically formed or parallel with the longitudinal axis of the bullet and a sabot which has a body and fingers which engage with the grooves and seal the bullet in a casing, the sabot having a slightly larger diameter than the bullet so that the sabot is engraved by the refling slots in the barrel through which the round is to be fired, in order to rotate the bullet. In alternative constructions the grooves contain elongate elements or a plurality of spherical elements to prevent the conically tapered slug or bullet from tilting or cocking in the barrel after firing.

19 Claims, 19 Drawing Figures

AMMUNITION ROUND

BACKGROUND OF THE INVENTION

The present invention relates to ammunition and particularly ammunition for use in conventional small arms weapons having rifled or non rifled barrels.

Conventional bullets for a rifled barrel usually have a lead core with a surrounding copper jacket of a diameter which is nominally the same as the groove diameter and is thus slightly oversize or an interference fit with regard to the bore diameter of the barrel of the weapon with which it is intended to be used, the copper jacket of the bullet being engraved and slightly compressed during its passage down the barrel of the weapon by the helical rifling grooves in the barrel. The bullet is spun by the rifling grooves to stabilize its flight, but a considerable proportion of the energy produced by the propellant in the casing containing the bullet is lost through friction between the bullet and the rifle barrel caused by the engraving of the bullet, the friction generating heat in the barrel. Particularly with weapons that fire fully automatically, heat generated by the friction of the bullets passing through the barrel can be a serious problem, causing rapid barrel erosion and, at worst, the barrel to bulge or burst.

A conventional shotgun slug is a hollow, cylindrical lead cup with a domed end. However, a shotgun has no rifling grooves to cause the slug to spin and is accurate only up to a range of about 100 meters or even less, partly due to this lack of spin and partly due to the slug's unstreamlined shape which slows it quickly.

It is known to surround an undersized rifle projectile with a plastic cup (sabot) which is engraved and spun by the barrel rifling and which in turn transmits the spin to the projectile by virtue of a tight friction grip. This has the disadvantage that the sabot material must have a high coefficient of friction to maintain its grip on the projectile, with a correspondingly high friction loss in the barrel. A further consequence is that the combined mass of the sabot and projectile is less than that of a conventional projectile of the same size, which therefore has less impulse for the same energy. The advantage of this is less gun recoil, but the disadvantage is that an unmodified conventional cartridge gun, will not complete its automatic cycle because of the reduced impulse.

It is also known to use a plastic sabot to surround a flechette and to have the barrel rifling only engrave the sabot, which transfers the rotation to the flechette by mechanical engagement with the fins of the flechette, instead of by a friction grip, and therefore a low coefficient of friction material can be used for the sabot with a resulting low friction loss in the barrel. One consequence of using a flechette however is that the combined weight of the sabot and flechette is very light when compared to a conventional bullet of the same diameter and length so that a special automatic gun must be used to function with the reduced impulse. A further problem with all sabot launched projectiles is that since the sabot and projectile exit from the barrel at the same velocity, the energy of each is determined by their relative mass to one another. The heavier the sabot is in relation to the projectile, the greater is the percentage of lost energy, since the sabot serves no useful purpose as a projectile. In the prior art, the body diameter (shaft) of a flechette is small in comparison to the sabot diameter, with a resulting large proportion of mass and energy in the sabot, so that the flechette gets a relatively small amount of the total energy and is therefore the least efficient of the sabot type projectiles.

France Pat. No. 1,124,740 shows a conventional shotgun cartridge which has cylindrical slug with parallel grooves which contain secondary, spherical projectiles. Except for using a conventional base wad to seal the gas pressure behind the shot this disclosure makes no use of the advantages of a sabot, but is nevertheless relevant to one aspect of the present invention.

It will readily be appreciated by those skilled in the art that the problems associated with the design of rifle and pistol rounds and shotgun cartridges, while having some features in common, are generally different in detail due to the different barrel environments and the uses to which the items are put.

SUMMARY OF THE INVENTION

One object of the present invention is to enhance the advantages of sabot ammunition and to minimize the disadvantages by mechanically transferring the rifling spin (instead of by friction) to the projectile and at the same time having the greatest possible cross section and mass in a streamlined projectile and minimum mass in the sabot.

The present invention also has as an object the provision of a streamlined, substantially full bore size bullet or slug. One application of the invention is to a rifle type ammunition round and a second application is to a shotgun cartridge.

According to a first aspect of the present invention, an ammunition round comprises a casing for containing a propelling charge, a substantially full bore diameter bullet which has a plurality of full length groove in its outer surface extending helically around or substantially parallel to the longitudinal axis of the bullet, and a sabot into which the bullet seats and which seals the bullet into the casing, the sabot having at least a part with a diameter slightly greater than the diameter of the bullet and a plurality of fingers engaging respective ones of the grooves in the bullet to cause the bullet to spin as the sabot is rotated by engagement with rifling grooves in a barrel through which the round is fired.

An ammunition round incorporating a sabot in accordance with this first aspect of the invention generates considerably less friction than a normal bullet in the barrel of a gun as the sabot is more easily engraved by the rifling grooves in the barrel and thus generates less friction as it travels along the barrel. The result is that a greater part of the initial energy is put into the bullet as kinetic energy (velocity) and less of the initial energy is converted into heat in the barrel.

According to a second aspect of the present invention, an ammunition round comprises a casing for containing a propelling charge, a substantially full bore diameter slug which has a plurality of full length grooves in its outer surface extending helically around or substantially parallel to the longitudinal axis of the slug, and a sabot into which the slug seats and which seals the slug into the casing, the sabot having a plurality of fingers seated in respective ones of the grooves in the slug, the fingers having a thickness substantially the same as the depth of the grooves and extending substantially the length of the slug thereby to stabilize the slug and prevent it from tilting off axis as it travels down the barrel through which it is fired.

The slug or bullet may be formed of lead or steel or other suitable metal, depending on the type of round in which it is to be incorporated and the type of use for which it is intended. Preferably, for military use, the bullet is formed of steel or a similar hard metal.

Preferably, the sabot comprises a resilient plastics molding. The fingers of the sabot may be hollowed out to lighten the sabot.

Preferably, in either aspect, the sabot has a body which is short in comparison with the length of the fingers, so that the fingers are flung radially outwards from the longitudinal axis of the bullet after it leaves the barrel by the spin of the bullet and sabot, the outward motion of the fingers thereby releasing the sabot from engagement with the grooves of the bullet and allowing air pressure to disengage the sabot completely from the bullet shortly after leaving the barrel.

The sabot may have a axial bore which allows the pressure of the propelling charge to force the sabot against the walls of the barrel into engagement with the rifling grooves. Alternatively, the rear of the bullet may have a tapered engagement with the body of the sabot to produce the same effect.

By forming full length grooves in the surface of the bullet, the bullet can be spin and/or fin stabilized during its passage through the air. When the bullet is formed with helical grooves, the spin rate is related to the forward velocity of the bullet in flight, so that as the forward velocity diminishes so does the spin rate.

By extending the grooves to the nose or leading end of the bullet the cross-sectional or frontal area of the bullet is decreased, thus increasing armor penetration and range.

According to a third aspect of the present invention, an ammunition round comprises a casing for containing a propelling charge, a substantially full bore diameter substantially conically tapered slug which has a plurality of full length grooves in its outer surface extending helically around or substantially parallel to the longitudinal axis of the slug, and a plurality of elongated elements seated in the grooves and having a thickness substantially the same as the depth of the grooves and extending substantially the length of the slug, to stabilize the slug and prevent it from tilting off axis as it travels down the barrel through which it is fired.

According to a fourth aspect of the invention, an ammunition round comprises a casing for containing a propelling charge and a substantially full bore diameter, substantially conically tapered bullet or slug which has a plurality of full length grooves in its outer surface extending helically around or substantially parallel to the longitudinal axis of the bullet or slug, each of the grooves is substantially U-shaped in cross-section and containing a plurality of spherical bodies having a diameter substantially equal to that of the cross-section of the groove, the spherical bodies being arranged in rows in each of the grooves to support and stabilize the bullet or slug in a barrel through which it is fired.

For military uses the slug may be formed of steel, with steel balls in the grooves, thus providing a multiple projectile round. The balls will scatter like a shotgun for short range and the central streamlined projectile has long range energy and accuracy, so the round can be used as in applications normally requiring a rifle.

The balls stabilize the slug and separate from it equally well whether the grooves are helical or parallel to the axis of the slug, but if they are helical then windflow through the grooves, after separation of the balls, begins to spin the slug and to spin stabilize its flight to improve accuracy.

The third and fourth embodiments are intended for use primarily as shotgun slugs and the bullet or slug may be made of steel or, as conventional, of lead. The presence of the elongate elements or spherical bodies in the grooves of the tapered slug prevents the slug from tilting or cocking as it passes down the barrel during firing. The elements or spherical bodies lying in the grooves may be formed of steel, plastics or any other suitable material.

Preferably, in the third and fourth embodiment, a conventional disc or wad is provided immediately to the rear of the bullet or slug to receive directly the force from the pressure of the propellant gas and thus transfer the force to the bullet or slug and the elements or spherical bodies uniformly.

By forming a shotgun slug as described above a highly streamlined projectile can be provided in a conventional shotgun cartridge without fear of the projectile cocking in the barrel when it is fired. The conventional shotgun slug, being substantially cylindrical, will not tilt or cock in the barrel, but is extremely inefficient as a ballistic shape, losing more than 60% of its energy in about the first 100 meters. This compares with a conventional ogival rifle bullet which starts with similar energy, but loses only 18% of this energy over the same distance.

Furthermore, where no element of the sabot is needed to transfer spin, such as for a shotgun, then that portion of the sabot which guides the projectile can be separate from the base of the sabot and be made to serve as both a stabilizing guide and as secondary projectiles.

As with a rifle bullet, the flutes or grooves in the slug reduce frontal area and wind resistance, to aid streamlining, and form fins to help stabilize the slug in flight. Unlike the first embodiment of the invention, however, the slug is not spun in the barrel and therefore the flutes or grooves do not serve the purpose of transferring the spin. Instead the balls, or other elements, in the grooves prevent the streamlined slug, with its ogival shape, from tilting in the barrel. Normal shotgun slugs have a cylindrical shape to prevent tilting, but of course, as a result, are not streamlined.

A conically tapered slug is particularly suited to a cartridge of the modern, star-crimped type in which the end of the casing is folded over to completely enclose the projectile and propellant.

It should be noted that all references to rifle ammunition apply to pistol ammunition as well, since both are fired through rifled barrels.

BRIEF DESCRIPTION OF THE DRAWINGS

Four embodiments of ammunition rounds constructed in accordance with the present invention will now be described with reference to the accompanying drawings in which.

DETAILED DESCRIPTION OF THE PREFERRED EMBODIMENTS

Figure 1:
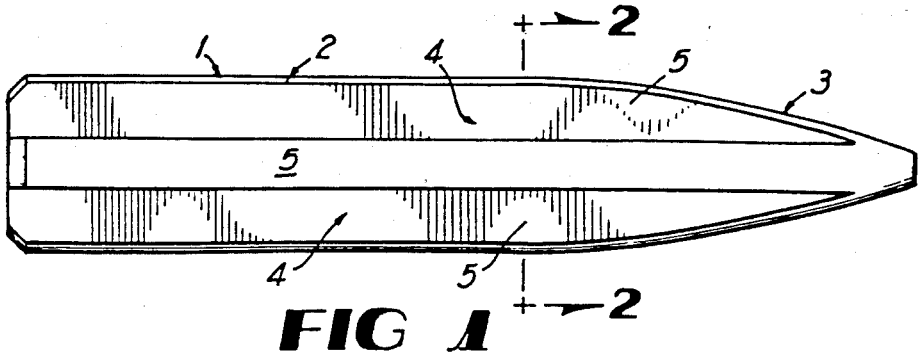
FIG. 1 is a side elevational view of a bullet.
Figure 2:
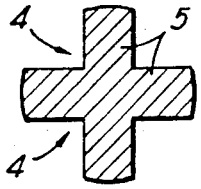
FIG. 2 is a section on the line II—II in FIG. 1.

When seen in elevation as in FIG. 1, the bullet 1 has a conventional outline having a parallel sided portion 2 and a tapered nose 3. The bullet is of substantially full bore diameter for the barrel for which it is intended to be used, but is just slightly less in diameter so as not to be engraved during firing as will be described later. However, unlike a conventional bullet the surface of the bullet is not a smooth cylindrical/tapered surface, but, rather, a plurality of V-shaped grooves 4 are formed extending parallel to the longitudinal axis 1' of the bullet, in the present embodiment there being four grooves and each of the grooves having a substantially 90° included angle at its base. This results in four elongate flanges 5 in a cruciform shape as shown in FIG. 2. The grooves 4 extend to the nose 3 of the bullet and the bullet thus presents a much smaller frontal area than a conventional bullet with a corresponding increase in the ability of the bullet to penetrate armour plating or the like.

Figure 3:
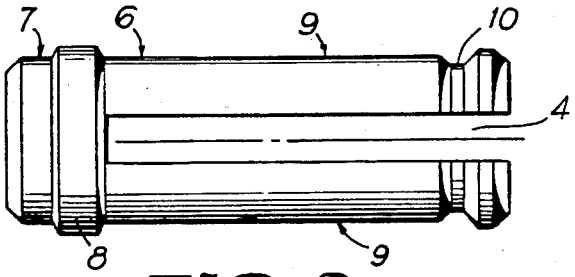
FIG. 3 is a side elevational view of a sabot.
Figure 4:
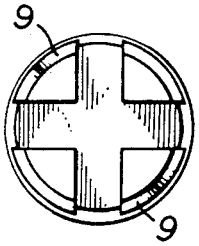
FIG. 4 is an end elevational view on arrow IV in FIG. 3.
Figure 5:
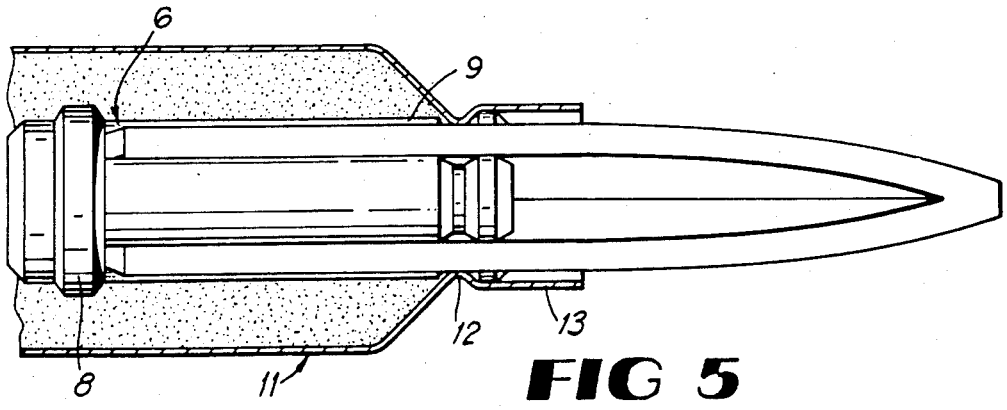
FIG. 5 shows the sabot assembled on the end of the bullet and the assembly fitted into the end of a casing.
Figure 6:
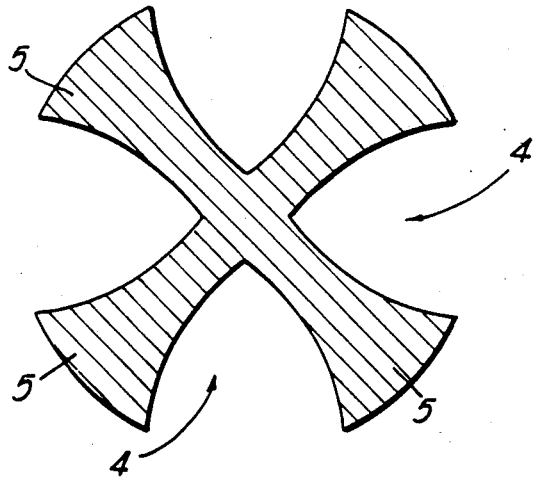
FIG. 6 is a cross-section of a shotgun slug.

At the end of the bullet remote from the nose, hereinafter called the rear, a sabot formed of a resilient plastics material such as nylon, is mounted in use. The sabot 6, as seen in FIGS. 3 and 4, has a generally cylindrical body part 7 with an enlarged diameter raised portion 8 which is of sufficient diameter to be engraved by the rifling and is therefore slightly larger than the nominal diameter of the bullet 1. This is best seen in FIG. 5. Extending from the body part 7 are a plurality, in the present embodiment four, fingers 9, each of which extend generally parallel to the central axis of the cylindrical body part 7 and each of which, when viewed in cross-section as in FIG. 4, comprises a substantially 90° segment which is a close fit within a respective groove 4 in the bullet.

At its free end each finger has as reduced thickness portion 10 which enables a casing 11, into which the assembly of the sabot and bullet are mounted together, to be crimped onto the assembled bullet 1 and sabot 6 (as shown at 12) at the casing's smaller diameter end portion 13 into which the assembly of bullet and sabot is fitted. The plastics material of the sabot seals the casing at the crimp 12 to make the round watertight during storage. The fingers 9 of the sabot 6 fill the grooves of the bullet behind the crimp 12 to prevent gas leakage through the grooves at ignition.

By way of example, a standard 5.56 military or 223 Remington barrel has a nominal bore diameter of 0.219 inches and the diameter to the base of the rifling grooves is nominally 0.224 inches, the width of the rifling grooves being 0.07 inches. The diameter of a bullet (as shown in the drawings) to fit is of maximum diameter 0.21875 inches and the width of the flanges 5 is 0.060 inches. The overall length of the bullet 1 is 1.127 inches. The nominal diameter of the sabot body 7 is 0.216 inches and that of the enlarged diameter portion 8 0.224 inches, the length of the portion 8 being 0.062 inches and the length of the body 7 being 0.125 inches.

In FIGS. 6 to 14 parts similar to those in FIGS. 1 through 5 are given the same reference number.

The slugs shown in these figures are intended as shotgun slugs. The slugs 1 have a highly conical tapered ogival shape (by conical in the present context is meant tapering over substantially its whole length and the term includes a non straight line generated taper), the ratio of the length of the slug to its diameter approaching unity, and each groove 4 contains either the finger 9 of a sabot 6 (FIGS. 7 through 9) or elongate metallic elements 14 (FIG. 10 and 11).

Figure 7:
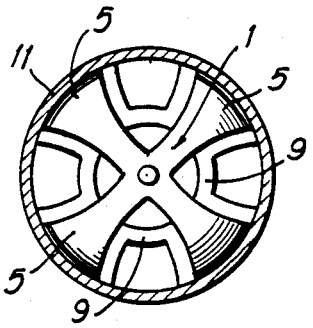
FIG. 7 is an axial section through a first shotgun cartridge.
Figure 8:
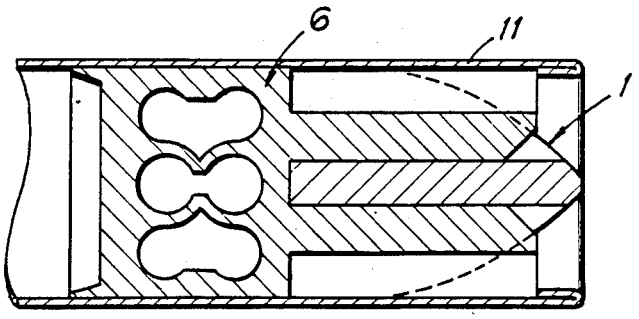
FIG. 8 is a radial section through said first shot gun cartridge.
Figure 9:
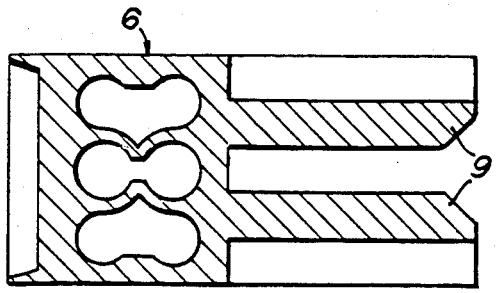
FIG. 9 is an elevation of the sabot of the cartridge of FIGS. 7 and 8.

Each of the fingers 9 in the slug of FIG. 7 has a hollow 16 in its radially outer surface to lighten the sabot.

Figure 10:
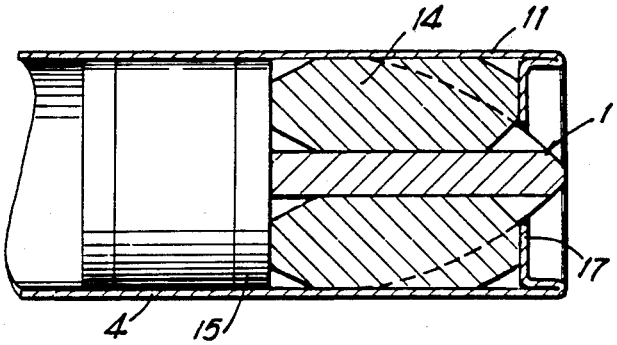
FIG. 10 is a radial section through a second shotgun cartridge.
Figure 11:
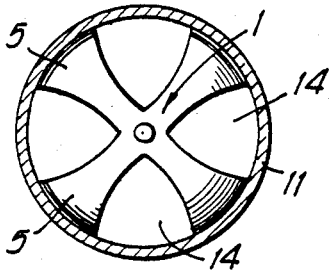
FIG. 11 is an axial section through said second shotgun cartridge.

The metallic elements 14 shown in FIGS. 10 and 11 comprise steel elements of equilateral curved triangular shape fitting congruently within the groove 4 in the slug 1 of FIGS. 10 and 11 and a disc shaped plug 15 is positioned immediately adjacent to the rear of the slug in order to provide a satisfactory seal to prevent gas pressure from passing around the sides of the slug and transferring the force of the propellant gas pressure uniformly to the slug and the elongate elements.

The cartridge illustrated in FIGS. 10 and 11 has a star-crimped end 17 which serves to retain the slug and elongate elements securely (without movement being possible) in the casing 11.

Figure 12:
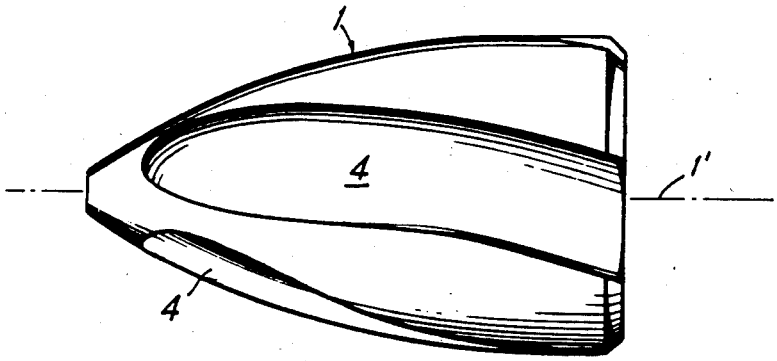
FIG. 12 is a side elevation of a third shotgun slug.
Figure 13:
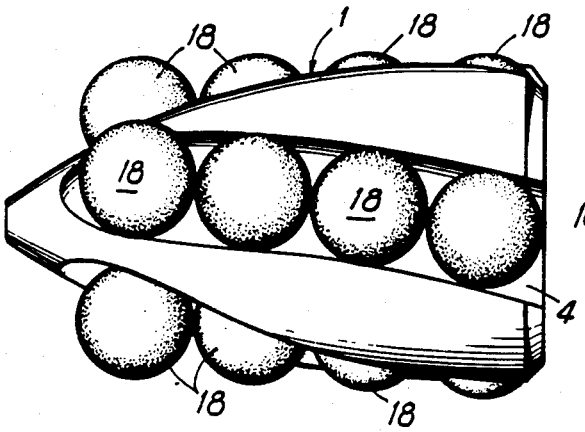
FIG. 13 is a side elevation of that slug with spherical bodies mounted on it.
Figure 14:
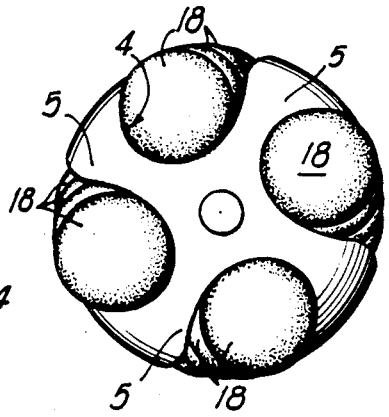
FIG. 14 is an end elevation on arrow XIV in FIG. 13.

FIGS. 12, 13 and 14 illustrate a steel shotgun slug 1 of conically tapered ogival outline having four helical grooves 4 equiangularly positioned around its central axis 11. In each of the grooves 4 four spherical bodies 18 are positioned, each of the spherical bodies 18 having a diameter substantially the same as, although slightly less than, the diameter of the cross-section of the groove 4. The spherical bodies are also preferably made of steel and may be conventional ball bearings. The circular sectioned wall of the grooves 4 supports the spherical bodies 18 which are retained within the grooves 4 in the radial direction, prior to firing by the wall of the casing, and during firing by the wall of the barrel.

The rear of the slug 1 is abutted by a plug or disc (as in the example of FIGS. 10 & 11) in order to provide a satisfactory seal to prevent gas pressure from passing around the sides of the slug and thus transfer the force of the propellant gas uniformly to the slug and spherical bodies. The casing will also be star crimped at its end as in the example of FIGS. 10 & 11.

While the example shown in FIGS. 12 through 14 has helical grooves, grooves parallel to the longitudinal axis of the slug may alternatively be provided as in the examples of FIGS. 6 through 11.

Figure 15:
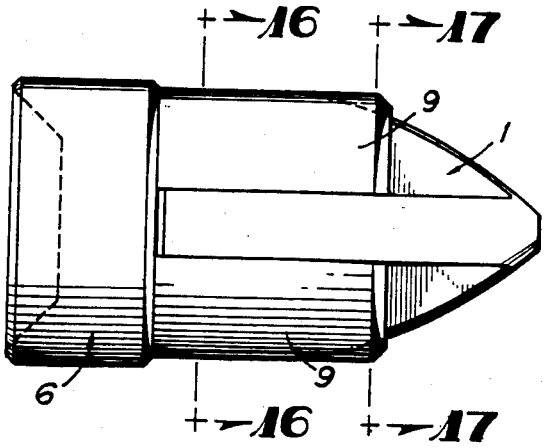
FIG. 15 is a side elevation of a pistol round.
Figure 16:
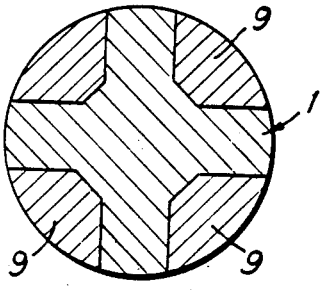
FIG. 16 and 17 are two cross-sections, on the line XVI—XVI and XVII—XVII, respectively, in FIG. 15.
Figure 17:
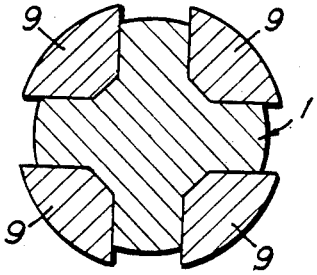
Figure 18:
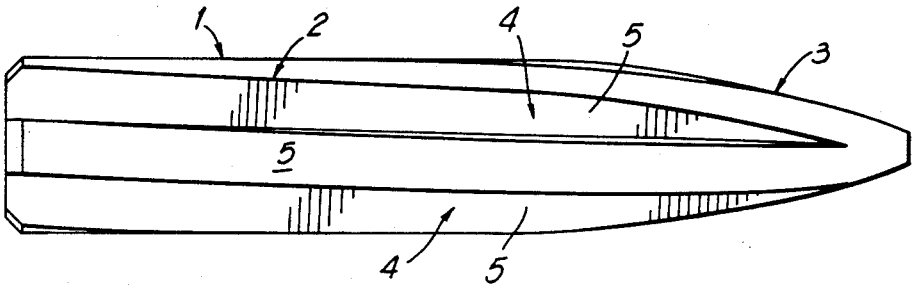
FIG. 18 is a side elevational view of a bullet having helical grooves along its length.
Figure 19:
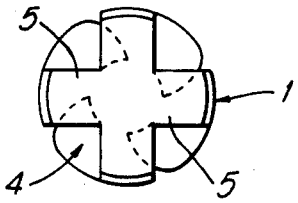
FIG. 19 is an end view of FIG. 18 from the rear.

As seen in FIG. 15 the fingers 9 of the sabot 6 can extend forward of the straight cylindrical portion of the bullet and on into the conical portion of the bullet thereby continuing the effect of a straight cylinder. This is particularly useful for a pistol bullet, which, like a shotgun slug, is necessarily short in relation to its diameter and so must be conical for most of its length in order to be streamlined. The support of the extended fingers 9 prevents the bullet from tilting off axis as it travels down the barrel.

Since both the rifle and a pistol have a rifled barrel to spin the bullet, both a rifle and a pistol bullet benefit from the resulting geometry of extending fingers into the conical portion in that the leading edge of the soft sabot, which protrudes beyond the diameter of the cone, would contact the rifling before the hard bullet as they move forward out of the cartridge case and into the rifled portion of the barrel. The projections formed by the leading edge of the fingers thus cushion the entry of the bullet into the rifling and prevent damage to the barrel.

What is claimed is:

1. An ammunition round comprising: a casing for containing a propelling charge; a full bore diameter bullet which has a plurality of full length grooves in its outer surface extending generally longitudinally of the bullet; and a homogeneous plastics sabot into which the bullet seats and which seals the bullet into the casing, the sabot comprising a body part with a diameter greater than the diameter of the bullet and a plurality of spaced apart fingers engaging respective ones of the grooves in the bullet to cause the bullet to spin as the sabot is rotated by engagement of said body part with rifling grooves in a barrel through which the round is fired.

2. A round according to claim 1 wherein each groove has a substantially V-shaped cross section.

3. A round according to claim 1, wherein each groove has a substantially U-shaped cross section.

4. A round according to claim 1, wherein said bullet is made of steel and is tapered.

5. A round according to claim 1, wherein said body part is short in comparison with the length of the fingers.

6. A round according to claim 1, wherein each of the fingers of said sabot has a reduced portion adjacent to its free end.

7. A round according to claim 5, wherein each of the fingers of said sabot has a reduced portion adjacent to its free end.

8. A round according to claim 1, wherein the fingers of said sabot each have a part-cylindrical radially outer surface, the fingers filling the respective grooves, and, with the flanges of said bullet between the grooves, forming a solid substantially circular section.

9. A round according to claim 5, wherein the fingers of said sabot each have a part-cylindrical radially outer surface, the fingers filling the respective grooves, and with the flanges of said bullet between the grooves, forming a solid substantially circular section.

10. A round according to claim 7, wherein the fingers of said sabot each have a part-cylindrical radially outer surface, the fingers filling the respective grooves, and with the flanges of said bullet between the grooves, forming a solid substantially circular section.

11. A round according to claim 1, wherein said full length grooves extend parallel to the longitudinal axis of the bullet.

12. A round according to claim 5, wherein said full length grooves extend parallel to the longitudinal axis of the bullet.

13. A round according to claim 10, wherein said full length grooves extend parallel to the longitudinal axis of the bullet.

14. A round according to claim 1, wherein said full length grooves extend helically around the longitudinal axis of the bullet.

15. A round according to claim 5, wherein said full length grooves extend helically around the longitudinal axis of the bullet.

16. A round according to claim 10, wherein said full length grooves extend helically around the longitudinal axis of the bullet.

17. A round according to claim 13, wherein said bullet is made of steel and is tapered.

18. A round according to claim 4, wherein the fingers of the sabot extend forward into the tapered portion of the bullet and form a full bore diameter support for the bullet about the diminished diameter of the tapered portion.

19. A round according to claim 7, wherein the finers of the sabot extend forward into the tapered portion of the bullet, and form a full bore diameter support for the bullet about the diminished diameter of the tapered portion.

* * * * *